United States Patent [19]

Lloyd

[11] 4,117,897

[45] Oct. 3, 1978

[54] DRILL BIT

[76] Inventor: Donald E. Lloyd, 1622 N. Delaware Pl., Tulsa, Okla. 74110

[21] Appl. No.: 805,812

[22] Filed: Jun. 13, 1977

[51] Int. Cl.[2] ..... E21B 1/06

[52] U.S. Cl. ..... 175/106; 175/228; 175/319; 299/85

[58] Field of Search ..... 175/107, 105, 106, 228, 175/319, 55; 299/85

[56] References Cited

U.S. PATENT DOCUMENTS

| | | | |
|---|---|---|---|
| 1,391,626 | 9/1921 | Gilthorpe | 175/106 |
| 2,400,853 | 5/1946 | Stilley | 175/106 |
| 2,797,065 | 6/1957 | Houston | 175/319 X |
| 2,859,941 | 11/1958 | Carroll et al. | 175/106 |
| 3,517,759 | 6/1970 | Crumbo | 175/106 X |

FOREIGN PATENT DOCUMENTS

| | | | |
|---|---|---|---|
| 404,937 | 4/1974 | U.S.S.R. | 299/85 |

*Primary Examiner*—Ernest R. Purser
*Assistant Examiner*—Richard E. Favreau
*Attorney, Agent, or Firm*—Head, Johnson & Chafin

[57] ABSTRACT

A drill bit comprising a body suspended in a well bore by an electrical cable which transmits power to a motor secured to the body and eccentric cam member rotated by the drive shaft of the motor and engagable with a plurality of reciprocal drill pins whereby the pins are sequentially impinged against the sidewalls and bottom of the well bore for producing a drilling operation.

9 Claims, 5 Drawing Figures

DRILL BIT

BACKGROUND OF THE INVENTION

1. Field of the Invention

This invention relates to improvements in drill bits and more particularly, but not by way of limitation, to a drill bit having a plurality of reciprocal drill pins engagable with the walls of the well bore to provide the drilling operation.

2. Description of the Prior Art

In the drilling of well bores, it is common practice today to secure a drill bit at one end of the drill pipe and lower the pipe into the well bore with the drill bit engagable with the bottom of the bore. The drill pipe is normally rotated at the surface of the well by a tool commonly known as a kelly, and as the drill pipe rotates, the drill bit is rotated simultaneously therewith, whereby the cutting elements of the drill bit cut away the bottom and sidewalls of the bore for producing the well drilling operation. The rotating of the drill pipe often becomes difficult, particularly as the well bore is drilling deeper and deeper into the earth; and as a consequence, many problems are encountered with the presently available drill bits.

SUMMARY OF THE INVENTION

The present invention contemplates a novel drill bit particularly designed and constructed for overcoming the disadvantages of the presently available drill bits. The novel drill bit comprises a body suspended in the well bore by a suitable electric cable which transmits electrical energy to a motor which is secured to the body in any suitable manner. The drive shaft of the motor is operably secured to an eccentric cam means which is engagable with a plurality of spring urged reciprocal drill pins or cutting tools. As the eccentric cam is rotated, the drill pins are sequentially reciprocated for impinging against the sidewalls and bottom of the well bore for producing a drilling operation. Sealing means is provided for protection of the moving elements of the device, and lubrication is achieved by an oil pumping action in combination with a splash method. Pressure equalizing means is provided for protection of the drill bit, particularly when the bore hole is of a substantially great depth since the bottom hole pressures may be considerable in these well drilling operations. In addition, an adequate flow of fluid, such as water, drilling mud, or the like, is provided for washing away cuttings and other debris during the drilling operation for assuring an efficient operation and long useful life for the drill bit. The bit is simple and efficient in operation and economical and durable in construction.

DESCRIPTION OF THE PREFERRED EMBODIMENT

Figure 1:
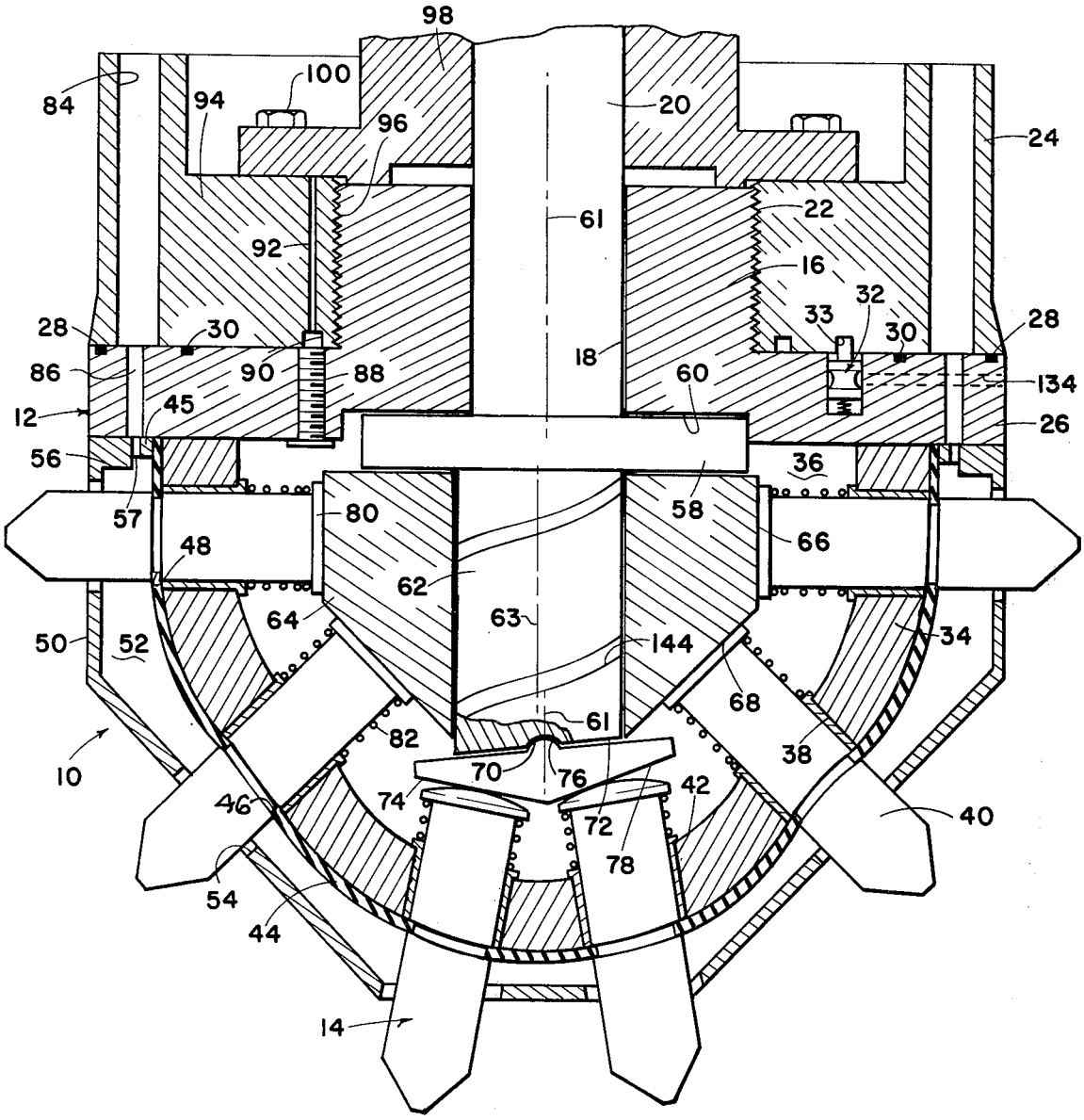
FIG. 1 is a sectional elevational view of a drill bit embodying the invention.

Referring to the drawings in detail and particularly to FIG. 1, reference character 10 generally indicates a drill bit comprising a suitable bearing 12 supporting a drill pin assembly 14. The bearing member may be of any suitable construction and as shown herein comprises a central hub member 16 having a central bore 18 extending longitudinally therethrough for receiving a rotatable shaft means 20 therein for a purpose as will be hereinafter set forth. The outer periphery of the hub member 16 is threaded as shown at 22 for threaded engagement with a substantially cylindrical housing 24, and an outwardly extending circumferential flange 26 is provided around the outer periphery of the hub 16 at one end thereof for engagement with the outer end of the housing 24 as particularly shown in FIG. 1. Of course, suitable sealing means, such as a plurality of concentrically arranged O-rings 28 and 30 may be interposed between the abutting faces of the flange 26 and housing 24 for precluding leakage of fluid therebetween as is well known. In addition, a suitable locking assembly generally indicated at 32 cooperates between the flange 26 and housing 24 for a locking engagement therebetween during a drilling operation, and the arrangement and operation of the locking assembly 32 will be hereinafter set forth in detail.

An inner substantially inverted dome shaped housing 34, preferably constructed from a suitable metallic material but not limited thereto, is secured to the outer surface of the flange 26 in any well-known manner (not shown) and is preferably substantially concentrically arranged with respect to the bore 18 for providing a lubrication chamber 36. A plurality of universally spaced bores 38 are provided in the dome 34 and arranged in substantially any desired array, each bore 38 having a drill pin 40 extending slidably therethrough. A flanged sealing sleeve 42 is interposed between each bore 38 and the outer periphery of the respective pin 40 for precluding leakage of fluid therearound. In addition, a resilient sealing cup 44, preferably constructed from a suitable corrosion resistant rubber material, or the like, is disposed against the outer periphery of the dome member 34 for sealing thereagainst. The cup 44 may be retained in position around the dome 34 by a suitable clamping ring 45, if desired, or any other suitable means may be utilized for securing the cup 44 to the dome 34. A plurality of universally spaced bores 46 are provided in the sealing cup 44 in alignment with the bores 38 whereby the pins 40 pass through the bores 46 as shown in FIG. 1. Each pin 40 is provided with an annular groove 48 extending around the outer peripehery thereof for receiving the edges of the respective bore 46 therein in order to provide additional sealing between the dome 34 and the pins 40, particularly during reciprocation of the pins 40 as will be hereinafter set forth.

An outer substantially inverted dome-shaped housing 50 is secured to the outer surface of the flange 26 in any well-known manner (not shown) and is preferably substantially concentrically arranged with respect to the inner dome 34 to provide a fluid chamber 52 therebetween. A plurality of bores 54 are provided in the outer housing 50 in substantial alignment with the bores 38 for loosely receiving the pins 40 therethrough. The bores 54 are preferably of a larger diameter than the outer diameter of the pins 40 for facilitating the flow of fluid therearound during the drilling operation in a manner and for a purpose as will be hereinafter set forth. In addition, the upper end of the outer housing 50 as viewed in FIG. 1 is provided with an inwardly directed circumferential flange 56 having an inner diameter greater than the outer diameter of the clamp ring 45 to provide an annular passageway 57 therebetween, said passageway 57 extending into communication with the fluid chamber 52.

The shaft 20 extends into the chamber 36 and is provided with an outwardly extending circumferential flange 58 extending around the outer periphery thereof for engagement with a centrally disposed substantially circular recess 60 provided on the outer face of the flange 26 surrounding the bore 18. As clearly shown in FIG. 1, the flange 58 is of an eccentric configuration, having a variable or varying width around the outer periphery of the shaft 20. In addition, whereas the cross-sectional configuration of the shaft 20 disposed in the bore 18 is substantially circular about the central axis 61 thereof, the shaft 20 is enlarged on the side of the flange 58 opposite the bore 18 as shown at 62. The cross-sectional configuration of the shaft portion 62 is eccentric generally corresponding to the eccentricity of the flange 58, and the central axis thereof indicated at 63 is offset from the axis 61. An annular cam member 64 is secured around the outer periphery of the shaft portion 62 in any suitable manner for movement simultaneously therewith and is provided with a substantially cylindrical portion 66 on the outer periphery of the upper portion thereof as viewed in FIG. 1. The cylindrical portion 66 is conterminous with an inwardly tapered or substantially conical shaped portion 68 for a purpose as will be hereinafter set forth.

The outer end of the shaft portion 62 is provided with a detent 70 which is disposed in substantial alignment with the axis 61 of the shaft portion 20, and the outer end of the shaft portion 62 is preferably angularly disposed or canted as shown at 72 in FIG. 1. A rocker plate 74 is disposed adjacent the canted surface 72 and is provided with a knob member 76 in engagement with the detent 70. The outer surface 78 of the rocker plate 74 is substantially conical for a purpose as will be hereinafter set forth.

The inwardly directed end of each pin 40 is provided with an outwardly extending circumferential flange 80 in engagement with the outer periphery of the cam member 64. Some of the flanges 80 are in engagement with the cylindrical surface 66, some of the flanges 80 are in engagement with the conical surface 68, and other of the flanges 80 are in engagement with the conical surface 78 of the rocker plate 74. A helical spring 82 is disposed around each pin 40 and interposed between the flange 80 and respective sleeve 38 for constantly urging the flange 80 in a direction toward the cam member 64 for assuring an efficient engagement of the pin 40 thereagainst during a drilling operation, as will be hereinafter set forth.

A plurality of spaced longitudinally extending fluid passageways 84 are provided in the sidewalls of the housing 24 in substantial alignment with the annular passageway 45. In addition, a plurality of spaced bores 86 are provided in the flange 26 in substantial alignment with the bores 84 and passageway 45 for providing communication therebetween. It will be apparent that an annular groove (not shown) may be provided on the upper surface of the flange 26 interposed between the sealing rings 28 and 30, if desired, said groove being in communication with the bores 84 and bores 86 for facilitating the communication with the bores 84 and bores 86, as is well known. In this manner a suitable fluid, such as water, drilling mud, or the like, may be delivered through the bores 84 and through the passageway 45 to the fluid chamber 52 as will be hereinafter set forth in detail.

In addition, a suitable filter fitting 88, or the like, may be disposed in the flange 26 having one end thereof in communication with the lubrication chamber 36 and the opposite end in communication with an annular recess 90 provided on the outer end of the housing 24. At least one passageway 92 extends through the bottom wall 94 of the housing 24 for providing communication between the groove 90 and the interior of the housing 24 for a purpose as will be hereinafter set forth. The fitting 88 provides communication of air from the recess 90 to the chamber 36 but precludes a reverse flow of lubricant from the chamber 36 to the recess 90.

A centrally disposed threaded bore 96 is provided in the bottom 94 of the housing 24 for receiving the hub 16 therein. In addition, a suitable motor 98, preferably an electric motor, but not limited thereto, is secured to the inner surface of the bottom 94 in any well-known manner, such as a plurality of bolts 100, whereby the motor 98 is offset with respect to the passageway 92 in order to preclude interference with the passage of pressure fluid into the chamber 36. The motor 98 is provided with the usual drive shaft (not shown), which may be operably connected or coupled with the rotatable shaft 20 in any suitable or well-known manner (not shown) for transmitting rotation to the shaft 20. The motor 98 may be suspended in a well bore (not shown) by a suitable electrical cable 102. The cable 102 preferably extends longitudinally through a central bore 104 of the housing 24 and beyond the housing 24 to the surface of the well bore for connection with a suitable supply source (not shown) for providing power for activation of the motor 98, as is well known. The pasageway 104 extending centrally into the housing 24 is open at the upper end thereof as shown at 106 in FIG. 2, whereby drilling fluid may be directed downwardly therethrough during the drilling operation, as is well known. In addition, the lower end of the bore 104 is preferably outwardly flared as shown at 108 in FIG. 2 for diverting the downward flow of the drilling fluid into the passageways 84 as will be hereinafter set forth.

Figure 2:
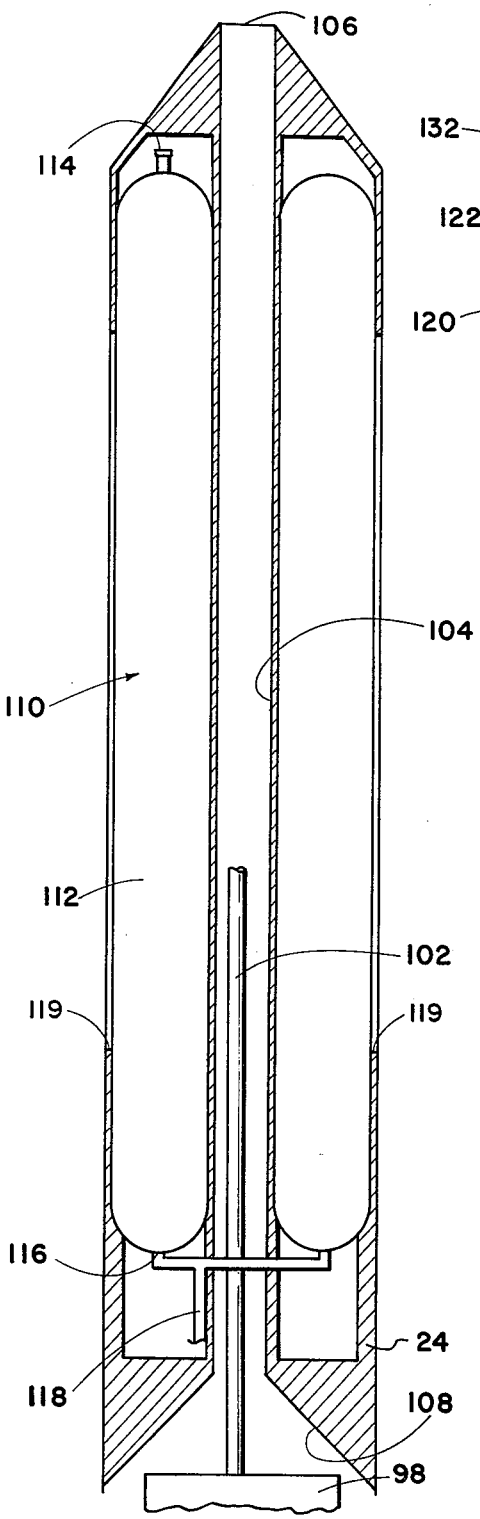
FIG. 2 is a sectional view, partly in elevation, of a pressure equalizer apparatus utilized with a drill bit embodying the invention.

Fluid pressure means 110 is disposed within the housing 24 are particularly shown in FIG. 2 and is preferably precharged or preloaded with a suitable pressure fluid, such as air, at a predetermined pressure. The pressure means 110 may comprise a single toriodal shaped chamber having the central bore thereof surrounding the passageway 102 or may comprise a plurality of elongated substantially cylindrical vessels 112, as desired. In the event a plurality of vessels 112 is utilized, as shown in FIG. 2, each vessel may be provided with an inlet port 114 whereby the pressure fluid may be admitted to the interior thereof, and a discharge port 116 for discharge of the pressure fluid therefrom. Of course, suitable valving means (not shown) is also provided for operation of the pressure system, as is well known. The ports 116 are preferably in communication with a common manifold or discharge passageway 118 which, in turn, is in communication with the passageway 92 in any suitable manner (not shown).

The vessels 112 are constructed from a suitable yieldable material, such as metal, heavy rubber, or the like, which is responsive to pressure differentials between the exterior and interior of the vessel for contracting or expanding in order to alternately discharge the pressure fluid therefrom, or admit the pressure fluid into the interior thereof, depending upon the relationship between the external and internal pressures, as will be hereinafter set forth. A plurality of spaced parts or slats 119 are provided in the sidewall of the housing 24 for communicating pressure from the exterior of the housing 24 to the exterior of the vessel or vessels 112.

The locking assembly 32 cooperates between the flange 26 and housing 24 for precluding relative rotational movement therebetween in the engaged position of the assembly 32. When the locking assembly is disengaged, the bearing member 12 may be unthreaded from the bore 96 for releasing the cutting elements 40 and associate parts from the housing 24.

Figure 4:
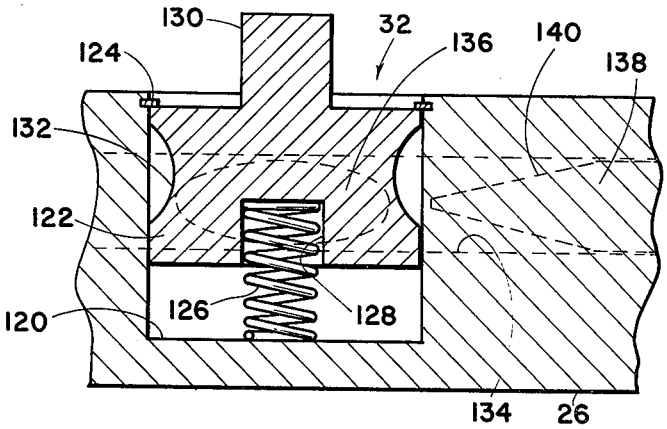
FIG. 4 is a view taken on line 4—4 of FIG. 3.
Figure 3:
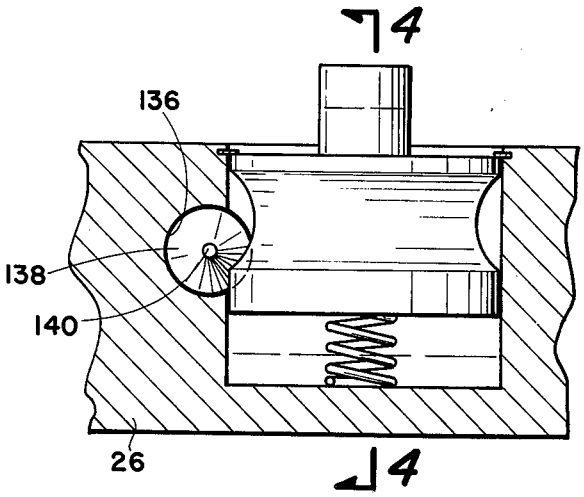
FIG. 3 is an enlarged sectional view of a locking device utilized in a drill bit embodying the invention, with portions depicted in elevation for purposes of illustration.

The locking assembly 32 may be of any suitable type, and as shown in FIGS. 3 and 4 comprises a bore 120 provided in the upper surface of the flange 26 as viewed in FIG. 1 for receiving a reciprocal piston member 122 therein. A suitable locking ring 124 is disposed in the bore 120 in the proximity of the outer end thereof for limiting the movement of the piston 122 in one direction, and a helical spring 126 is anchored between the botton of the bore 120 and a central recess 128 provided in the inner face of the piston 122 whereby the piston 122 is constantly urged in a direction toward the locking ring 124. A stem member or locking element 130 is centrally disposed on the outer face of the piston 122 and extends axially outwardly therefrom for protruding beyond the adjacent surface of the flange 26 in the normal locking position thereof shown in FIGS. 1, 3, and 4.

An annular recess 132 is provided around the outer periphery of the piston member 122, and a bore 134 (FIGS. 1 and 4) extends through the flange 26 from the outer periphery of the flange and into communication with the bore 120. If desired, the bore 134 may extend beyond the bores 120, as particularly shown in FIG. 4). The bore 134 is slightly offset with regard to the longitudinal center of the bore 120 whereby a recess 136 is formed in the inner periphery of the bore 120 as will be seen in FIGS. 3 and 4. The size and position of the annular recess 132 with relation to the bore 134 and recess 136 is particularly selected whereby the recess 132 will be in communication with the bore 134 and recess 136 regardless of the position of the piston 122 in the bore 120.

An unlatching pin 138 is provided for insertion into and through the bore 134 and is provided with a tapered end 140 whereby as the pin 138 is inserted into the bore 134, the tapered end 140 will move into the recess 136 and initially engage the annular recess 132 as the tapered end 140 enters the bore 120. A continued movement of the pin 128 into the recess 136 will cause the piston 122 to move against the force of the spring 126, thus moving the locking element 130 in an inward direction with respect to the bore 120. When the locking element 130 has moved through a sufficient distance whereby the outer end thereof no longer protrudes beyond the face of the flange 26, the bearing 12 will be unlocked from the housing 24 whereby the bearing may be threadedly removed from engagement therewith.

Figure 5:
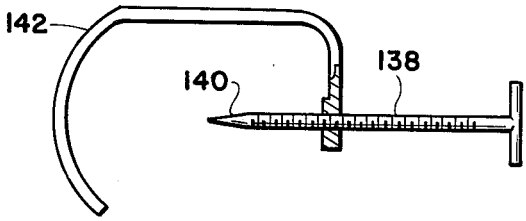
FIG. 5 is a side elevational view of an unlocking tool such as utilized with a drill bit embodying the invention.

The pin 138 may be carried by a support bracket 142, if desired, and as shown in FIG. 5. The configuration of the bracket 142 is preferably substantially complementary to the configuration of the outer periphery of the drill bit, particularly in the proximity of the flange 26, whereby the bracket 142 may straddle a portion thereof for positioning the pin 138 in approximate alignment with the bore 134. The pin 138 may be threadedly secured to the bracket 142, as is well known, for facilitating the movement of the pin 138 through the bore 134 and into the bore 120.

In use, a suitable lubricant, such as oil, may be deposited in the chamber 36, and the lubricant surrounds the elements disposed in the chamber 36 for assuring an adequate lubrication thereof. It may also be desirable to provide a spiral or helical groove 144 around the outer periphery of at least the shaft portion 62 for increasing the lubricating efficiency. The sealing or bushing sleeves 42 facilitate the reciprocation of the drill pins or cutting elements 40, and the shaft 20 in combination with the flange 58 and shaft portion 62 provide a balancing unit for facilitating the operation of the drill bit during the well bore drilling operation.

The entire apparatus 10, including the housing 24, motor 98, and fluid pressure means 110 may be suspended in the well bore (not shown) by the cable 102, said cable extending to the surface of the well bore not only for supporting the apparatus but also for supplying power for actuation of the motor 98. Of course, the proper controls for actuation and operation of the motor 98 are provided at the surface of the well bore as is well known for facilitating operation of the drill bit 10 by the well drilling personnel.

When the bit 10 is disposed in the well bore, the motor 98 may be activated whereby the drive shaft of the motor will transmit rotation to the shaft 20 of the balancing unit. As the shaft 20 rotates, the cam member 64 is rotated simultaneously therewith. As the cam 64 rotates, the cutting elements 40 are sequentially reciprocated within the respective bushing sleeves 42, and the cutting tips of the pins 40 engage the inner periphery of the well bore for providing the well bore drilling operation. Of course, the rocker plate 74 is oscillated as the shaft 20 is rotated for sequentially reciprocating the pins 40 in engagement with the rocker plate. It will be apparent that the random and universal type spacing of the drill pins 40 provides a substantially universal cutting area for the drill bit 40. Whereas the particular embodiment depicted herein does not illustrate vertically upwardly extending drill pins, it will be apparent that the configuration of the outer periphery of the cam element 64 may be designed for actuation of upwardly extending pins, if desired. Of course, the lubricant in the chamber 36 assures an adequate lubrication of the reciprocating pins and rotating elements of the drill bit. The sealing cup 44 precludes leakage of the lubricant from the chamber 36 and seals the chamber 36 from contamination by debris or other foreign particles.

The usual drilling fluid, such as water, drilling muds, or the like, may be pumped downward in the well bore (not shown) in the usual manner whereby the muds will move downwardly through the bore 104 of the housing 24. The drilling fluids wash downwardly over the motor 98 and through the passageways 84 where they are discharged into the chamber 52. The drilling fluids circulate through the chamber 52 and around the pins 40 and are discharged through the ports 54 surrounding the pins. This assures an efficient washing of the cuttings and the like during the drilling operation, and the removed debris may be elevated to the surface of the well bore with the drilling fluids in the usual of well-known manner.

As a well bore is drilled deeper and deeper into the earth, the pressures encountered in the well bore increase and may become exceedingly great. The fluid pressure means 110 is provided in order to compensate for any excessive down hole pressures during a drilling operation. The pressure vessel or vessels 112 are precharged or preloaded with a suitable pressure fluid, such as air, as hereinbefore set forth, and at a predetermined pressure. The pressure in the well bore is communicated to the exterior of the vessels 112 through the ports 119; and as long as the pressure in the well bore does not exceed the pressure within the vessels, the pressure of the well bore will not be sufficiently great as to have any adverse effect on the drilling operation. However, when the well bore pressure increases to a point beyond the predetermined pressure within the vessels 112, the walls of the vessel will flex inwardly or collapse, whereby the pressure fluid contained therein will be forced out through the passageway 118 and into the chamber 36 through the passageway 88. The pressure admitted into the chamber 36 will compensate for the excessive pressure surrounding the bit and protect the elements thereof against any damage from the pressure.

When the bearing 12 is to be removed from engagement with the housing for any reason, the unlatching pin 138 may be inserted into and through the bore 134 for engaging the annular recess or groove 132 of the piston 122 whereby the piston will be moved in a direction away from the housing for releasing the locking pin 130 from engagement therewith. The bearing 12 may then be unthreaded from engagement with the housing 24. Of course, the procedure is reversed when the bearing 12 is to be secured to the housing 24. The piston 122 is retained in the retracted position thereof within the bore 120 by the engagement of the pin 138 therewith; and when the bearing 12 has been threadedly secured to the housing 24, the pin 138 may be removed for releasing the piston 132 in order that the spring 126 may extend the piston for moving the latching pin 130 into the recess 33 (FIG. 1) provided in the outer end of the housing 24. It will be apparent that a slight rotational orientation between the bearing 12 and the housing 24 may be required in order to assure that the latch pin 130 will be in alignment with the recess 33 for insertion therein.

Whereas the particular operation and embodiment of the invention shown and described herein is directed to the drilling of a well bore, it is to be understood that horizontally extending excavations may also be produced with the drill bit 10. For example, in the drilling of tunnels through a mountain, or the like, or in mining excavations, a plurality or bundle of the drill bits 10 may be utilized in concert or unison for driving a substantially horizontally extending bore through the earth.

From the foregoing, it will be apparent that the present invention provides a novel drill bit for boring operation in the earth wherein the drill bit is provided with a plurality of reciprocal drill pins or cutting tools in lieu of the conventional rotational cutting elements. The novel drill bit may be suspended in a well bore, or the like, by a suitable electric cable which supplies power to the motor which drives a cam mechanism engagable with the drill pins for sequential reciprocation thereof. A lubrication chamber is provided for assuring an efficient lubrication of the working elements of the bit, and a fluid chamber is provided for directing a flow of water or drilling fluid through the bit and around the cutting elements for removing cuttings and other debris from the cutting portions of the pins, thus assuring an efficient drilling operation.

Whereas the present invention has been described in particular relation to the drawings attached hereto, it should be understood that other and further modifications, apart from those shown or suggested herein, may be made within the spirit and scope of this invention.

What is claimed is:

1. Drill bit means comprising rotatable eccentric cam means, non-rotatable bearing means disposed around said cam means, apertured inner housing means carried by said bearing means and surrounding a portion of said cam means, cutting tool means reciprocally disposed in each aperture of the inner housing means and having one end engagable with the cam means and the opposite end extending exteriorly of the inner housing means, lubrication chamber means provided in said inner housing means and around said cam means for lubrication of the cutting tool means, seal means provided for said inner housing means for precluding leakage of fluid therefrom, apertured outer housing means carried by said bearing means and substantially concentrically arranged with respect to said housing means, the apertures of said outer housing means being in substantial alignment with the apertures of the inner housing means for loosely receiving the cutting tool means therethrough, and fluid chamber means provided in said outer housing means for receiving fluid and discharging said fluid around the cutting tool means for facilitating the drilling operation.

2. Drill bit means as set forth in claim 1 and including pressure compensating means in communication with the lubrication chamber for equalizing the internal and external pressure acting on said inner housing means.

3. Drill bit means as set forth in claim 1 wherein the inner housing means comprises a substantially inverted dome-shaped housing secured to the outer face of the bearing means, a plurality of universally spaced apertures extending through the housing walls, bushing sleeve means provided in each aperture for slidably receiving a cutting tool means therethrough.

4. Drill bit means as set forth in claim 1 wherein the seal means comprises a sealing cup member of a configuration complementary to the outer periphery of the inner housing means for disposition immediately thereagainst, said sealing cup member being provided with a plurality of apertures in substantial alignment with the apertures of the inner housing and engagable with the outer periphery of the respective cutting tool means extending therethrough for sealing therearound.

5. Drill bit means as set forth in claim 1 wherein the eccentric cam means comprises rotatable balancing shaft means, an eccentric cam element carried by said balancing shaft means and rotatable therewith for sequentially reciprocating a portion of said cutting tool means, and rocker plate means carried by said balancing shaft means for sequential reciprocation of the remaining portion of said cutting tool means.

6. Drill bit means as set forth in claim 1 wherein the cutting tool means comprises a plurality of cutting elements, one of which extends through each aperture of the inner housing means, an outwardly extending circumferential flange provided at one end of each cutting element and in engagement with the outer periphery of the cam means, spring means disposed around each cutting element and anchored between the inner periphery of the inner housing means and the respective circumferential flange for constantly urging the cutting element in a direction toward the cam means, and cutting means provided on the outer end of each cutting element for providing the drilling operation.

7. Drill bit means as set forth in claim 1 wherein the bearing means comprises substantially cylindrical housing means having a centrally disposed bore extending longitudinally therein, an annular shoulder provided at one end of said housing means and having threaded bore means therein, flanged bearing sleeve means threadedly secured in said threaded bore means, locking means for releasably securing said bearing sleeve means in said threaded bore means, passageway means provided in the sidewall of said housing means and in communication with the longitudinal bore extending therethrough, aperture means provided in said bearing sleeve means providing communication between said passageway means and said fluid chamber whereby fluid may be directed through the longitudinal bore and to the fluid chamber during a drilling operation.

8. Drill bit means as set forth in claim 7 and including power supply means secured to said annular shoulder and operably connected with said rotatable eccentric cam means for providing said rotation therefor.

9. Drill bit means as set forth in claim 8 and including pressure compensating means carried by said housing means, passageway means provided in said housing means in communication with the interior of said pressure compensating means for receiving pressure fluid therefrom and directing pressure fluid thereto, and passageway means provided in said bearing sleeve in communication with the last-mentioned passageway means and the lubrication chamber for directing the pressure fluid thereto and withdrawing the pressure fluid therefrom.

* * * * *